US005551369A

United States Patent [19]

Shen

[11] Patent Number: 5,551,369

[45] Date of Patent: Sep. 3, 1996

[54] DUALCAVITATING HYDROFOIL STRUCTURES

[75] Inventor: Young T. Shen, Potomac, Md.

[73] Assignee: The United States of America as represented by the Secretary of the Navy, Washington, D.C.

[21] Appl. No.: 414,836

[22] Filed: Mar. 31, 1995

[51] Int. Cl.[6] ..... B63B 1/24

[52] U.S. Cl. ..... 114/274

[58] Field of Search ..... 114/274, 278, 114/280; 244/35 R

[56] References Cited

U.S. PATENT DOCUMENTS

| | | | |
|---|---|---|---|
| 2,890,672 | 6/1959 | Boericke, Jr. | 114/274 |
| 3,016,863 | 1/1962 | Johnson, Jr. | 114/66.5 |
| 3,065,723 | 11/1962 | Tulin | 114/66.5 |
| 3,077,173 | 2/1963 | Lang | 114/66.5 |
| 4,188,906 | 2/1980 | Tachmindji et al. | 115/34 R |
| 4,293,280 | 10/1981 | Yim | 416/237 |

FOREIGN PATENT DOCUMENTS

| | | | |
|---|---|---|---|
| 2313254 | 4/1977 | France | 114/278 |
| 2395881 | 3/1979 | France | 114/274 |

OTHER PUBLICATIONS

Eppler, Richard and Young T. Shen, "Wing Sections for Hydrofoils–Part I: Symmetrical Profiles," Journal of Ship Research, vol. 23, No. 3, (Sep. 1979), pp. 209–217.

Shen, Young T. and Richard Eppler, "Wing Sections for Hydrofoils–Part II: Nonsymmetrical Profiles," Journal of Ship Research, vol. 25, No. 3, (Sep. 1981), pp. 191–200.

Shen, Young T., "Wing Sections for Hydrofoils–Part 3: Experimental Verification," Journal of Ship Research, vol. 29, No. 1, (Mar. 1985), pp. 39–50.

*Primary Examiner*—Edwin L. Swinehart
*Attorney, Agent, or Firm*—Gary G. Borda

[57] ABSTRACT

The invention is directed to hydrofoil structures for efficient operation over a wide speed range from subcavitating to supercavitating operation. A dualcavitating hydrofoil is provided that overcomes cavitation problems associated with high speed operation of prior art subcavitating hydrofoil structures by providing a supercavitating profile shape in the lower surface to achieve a supercavitating condition at high speeds, and that overcomes problems associated with low speed operation of prior art supercavitating hydrofoil structures by providing an upper surface that combines with the lower surface to form a streamlined cross-sectional shape that achieves a smooth flow exit at the trailing edge for efficient, low drag, high lift subcavitating operation. The lower surface is shaped to efficiently produce a lift force during normal supercavitating operation wherein the lower surface functions to generate a cavity extending aft from the leading edge, the upper surface being completely enveloped within the cavity and the lower surface being at least partially wetted during normal supercavitating operation. The upper surface is shaped to efficiently produce a lift force during normal subcavitating operation wherein the upper and lower surfaces are fully wetted during normal subcavitating operation.

20 Claims, 5 Drawing Sheets

DUALCAVITATING HYDROFOIL STRUCTURES

STATEMENT OF GOVERNMENT RIGHTS

The invention described herein may be manufactured and used by or for the Government of the United States of America for governmental purposes without the payment of any royalties thereon or therefor.

BACKGROUND OF THE INVENTION

1. Field of Invention

The present invention relates generally to hydrofoil structures commonly employed to generate lift or thrust for marine applications such as for example, foils of high speed hydrofoil crafts, blades of marine propellers, and impellers of fluid pumps or turbines, where a lift force is produced by movement of the hydrofoil structure relative to the surrounding water. More particularly, the present invention relates to hydrofoil structures for efficient operation over a wide speed range from subcavitating to supercavitating operation.

2. Brief Description of Related Art

There is presently a great interest in providing high speed ships and ship propulsors capable of efficient operation at high speeds. Hydrofoil crafts have been used where operation above 45 knots is desired. The hydrodynamic characteristics of lift producing hydrofoil structures are very similar to the subsonic aerodynamic characteristics of aircraft wings. Thus, it has been possible to adapt many airfoil theories and computational techniques to hydrofoil and propeller blade section designs. However, there exists a major distinction between hydrofoil structures and aircraft wings. Operated below the free surface, a hydrofoil or propeller will develop vortex cavitation and surface cavitation on the foil or blade above a certain critical speed. Cavitation inception occurs when the local pressure falls to or below the vapor pressure of the surrounding fluid. Cavitation inception can be predicted from the pressure distribution over the hydrofoil structures since the cavitation inception index $\sigma_i$ is equal to the negative minimum pressure coefficient $-C_{pmin}$. Above the critical cavitation inception speed, serious fundamental flow changes occur that lead to undesirable variations in hydrodynamic characteristics (e.g., loss of lift in hydrofoils and thrust breakdown in propellers) and possible damage to foil or blade structure. Consequently, the major obstacle to achieving high sustained speeds in water is the occurrence of cavitation with its many detrimental effects. Consequently, the design philosophy for hydrofoil and propeller blade sections has been governed by the following requirements: (1) provide the required lift/thrust at a specified design point while ensuring adequate structural strength (especially at thin leading and trailing edges) for all operating conditions; and (2) avoid or minimize cavitation or the detrimental effects of cavitation. To this end, three distinct hydrofoil structures, i.e., subcavitating, base ventilated and supercavitating designs, have been proposed for use at different design speeds.

Subcavitating hydrofoil structures generally have conventional airfoil shaped profiles (cross-sectional shapes) selected, for example, from the NASA design literature, such as NACA 16-series or NACA 6-series laminar airfoils, and are designed to operate fully wetted over both the upper and lower surfaces. Such profiles derive most of their lift from their upper surfaces. However, the shape of the upper and lower surfaces influence the pressure distribution produced by the other. Thus, to produce an efficient hydrofoil structure having a high lift-to-drag ratio, the upper and lower surface shapes should be designed together as an integral unit. Subcavitating hydrofoil structures operate efficiently, with high lift-to-drag ratios, at speed up to the critical speed at which the hydrofoil begins to experience cavitation, i.e., the critical cavitation inception speed. The critical cavitation inception speed may be increased through design methods such as varying the profile geometric characteristics, e.g., lowering the camber (to reduce hydrodynamic loading at the expense of efficiency) and/or reducing the section thickness (to reduce suction pressure $-C_{pmin}$ at the expense of structural strength), or by restricting operation to lower sea states in order to reduce craft motions and maintain an angle of attack near the design angle. Typically, a subcavitating hydrofoil is efficient up to a critical speed of about 45 knots while a subcavitating propeller is efficient up to a critical speed of about 25 to 30 knots.

Due to the occurrence of cavitation, subcavitating hydrofoil structures are not practical for marine applications beyond the critical cavitation inception speed. To overcome the problems associated with cavitation on subcavitating hydrofoil structures, supercavitating hydrofoils and fully wetted base ventilated hydrofoils were developed in the 1960's for high speed marine applications.

Supercavitating hydrofoil structures are predominantly used at high speeds where subcavitating hydrofoil structures are impractical due to cavitation. Supercavitating hydrofoil structures generally have a triangular or wedge shaped profile with a sharp leading edge and a blunt trailing edge. Profile thickness typically increases from a minimum at the sharp leading edge to a maximum at the blunt trailing edge. The supercavitating condition is initiated at high speeds (supercavitating speeds) when the sharp leading edge causes formation of a fully developed cavity over the entire upper surface. Cavity collapse occurs well abaft of the trailing edge, thus, problems of buffeting and erosion associated with cavitation on subcavitating hydrofoil structures are avoided. The lift producing lower surface of a supercavitating profile is generally flat or concave and is designed using well known supercavitating theory to produce operating pressures greater than ambient pressure so as to prevent cavitation. It is noted that NACA sections, which have been extensively used in subcavitating hydrofoil and marine propeller design, typically have convex lower surfaces that are not efficient lift producers under supercavitating conditions. Because supercavitating profiles derive their lift primarily from increased pressure over the lower surface, with the upper surface exerting no influence on lift production at supercavitating speeds, the lower surface shape is designed with little or no regards to the upper surface shape. The shape of the upper surface is immaterial as long as it does not contact the cavity wall, i.e., the free-surface between the air or vapor filled cavity and the water. Therefore, the upper surface is generally flat, although it may have a slight curvature in order to provide thickness for strength.

To achieve a supercavitating condition, a supercavitating hydrofoil or propeller must operate at high speeds and low cavitation numbers. At supercavitating speeds, the presence of the cavity generates a cavity drag that lowers efficiency. Moreover, due to extreme inefficiency prior to achieving supercavitating conditions, supercavitating hydrofoil structures are impractical for low speed operation, thus, necessitating secondary means of producing lift or thrust at low speeds. To maintain a reasonable efficiency, the lower limit for application of supercavitating hydrofoils is approximately 50 knots while the lower limit for application of supercavitating propellers is approximately 45 to 50 knots.

Below these speeds, only a partial cavity develops resulting in cavity collapse forward of the trailing edge causing buffeting and erosion. Additional obstacles associated with use of supercavitating hydrofoils include: the high angle of attack needed to generate a reliable, steady cavity compared to subcavitating hydrofoils, results in large drag and low efficiency, especially at off design speeds; due to increased form drag at low speeds the lift-to-drag ratio is small compared to subcavitating hydrofoils, consequently, supercavitating hydrofoils have difficulty generating sufficient lift for take-off while supercavitating propellers have difficulty generating sufficient thrust to overcome a ship's hump drag; and obtaining structural strength of the thin leading edge is difficult.

Base ventilated hydrofoil structures have been proposed for use at design speeds falling in the intermediate range between subcavitating and supercavitating speeds. Base ventilated hydrofoil structures are similar in shape to supercavitating hydrofoils in that they generally have triangular or wedge shaped profiles with blunt trailing edges. Base ventilated hydrofoil structures, however, have thicker or blunter leading edges than supercavitating profiles to prevent formation of a cavity over the entire upper surface. The profile thickness increases from leading edge to trailing edge so that base ventilated hydrofoils can operate cavitation free at higher speeds than subcavitating profiles at the expense of increased form drag and lowers efficiency. To partially compensate for the increased form drag, base ventilated hydrofoil structures have a gas introduced into the flow behind the blunt trailing edge resulting in lower form drag than supercavitating profiles. However, efficiency at low speeds is less than subcavitating hydrofoils and, because base ventilated hydrofoil structures are designed to operated with the upper and lower surfaces fully wetted, lift force produced is sensitive to variations in angle of attack.

Subcavitating hydrofoils for low speed operation (typically less than about 45 knots), supercavitating hydrofoils for high speed operation (typically above about 50 to 60 knots) and base ventilated for intermediate speed operation have been known for some time. FIG. 1 presents representative plots of efficiency (as represented by lift-to-drag ratio) as a function of speed for fully-wetted-subcavitating (curve A), base ventilated (curve B), and supercavitating (curve C) hydrofoils. However, presently, there is no hydrofoil or propeller design capable of operating over a wide speed range, i.e., a speed range that encompasses subcavitating, base ventilated and supercavitating operating ranges, without experiencing the problems described above. Consequently, hydrofoils have generally been limited to efficient operation in only one of the subcavitating, base ventilated or the supercavitating regimes. Therefore, there is a need to provide a hydrofoil structure for use as a hydrofoil or marine propeller that overcomes the problems and operational limitation associated with subcavitating, base ventilated and supercavitating hydrofoils and propellers.

SUMMARY OF THE INVENTION

Accordingly, it is an object of the present invention to provide a hydrofoil structure for operation over a wider speed range than known hydrofoils.

It is a further object of the present invention to provide a hydrofoil structure designed with dualcavitating characteristics capable of efficient operation at low speeds while in a subcavitating mode and at high speeds while in a supercavitating mode.

It is still a further object of the present invention to provide a hydrofoil structure designed with dualcavitating characteristics capable of efficient operation at low speeds while in a subcavitating mode, at intermediate speeds while in a base ventilated mode, and at high speeds while in a supercavitating mode.

Other objects and advantages of the present invention will become apparent to those skilled in the art upon a reading of the following detailed description taken in conjunction with the drawings and the claims supported thereby.

A dualcavitating hydrofoil is provided that overcomes cavitation problems associated with high speed operation of prior art subcavitating hydrofoil structures by providing a supercavitating profile shape in the lower surface to achieve a supercavitating condition at high speeds, and that overcomes problems associated with low speed operation of prior art supercavitating hydrofoil structures by providing an upper surface that combines with the lower surface to form a cross-sectional shape that achieves a smooth flow exit at the trailing edge for efficient, low drag, high lift subcavitating operation. In accordance with the present invention, a dualcavitating hydrofoil for providing dynamic lift sufficient to lift a marine vehicle above a water surface is provided. The dualcavitating hydrofoil of the present invention includes an upper surface, a lower surface, a leading edge formed by a forward or upstream intersection of the upper and lower surfaces, and a trailing edge formed by an aft or downstream intersection of the upper and lower surfaces. The upper and lower surfaces extend between first and second lateral ends and define a streamlined cross-sectional shape. The upper surface is adapted to efficiently produce the lift force during normal subcavitating operation at subcavitating speeds wherein the upper and lower surfaces are fully wetted. The lower surface is adapted to efficiently produce the lift force during normal supercavitating operation at supercavitating speeds wherein the upper surface is enveloped within an air or vapor filled cavity generated by the lower surface and at least a portion of the lower surface is wetted. The cavity has a cavity streamline defined by the outer edge of the cavity, i.e., the interface between the air or vapor filled cavity and the surrounding water.

The upper surface of the dualcavitating hydrofoil is divided into a forward upper segment extending aft from the leading edge and an aft upper segment extending forward from the trailing edge, the forward upper segment being adjacent the aft upper segment at an upper junction. The lower surface of the dualcavitating hydrofoil is divided into a forward lower segment extending aft from the leading edge and an aft lower segment extending forward from the trailing edge, the forward lower segment being adjacent the aft lower segment at a lower junction. The forward upper and forward lower segments define a forward section and the aft upper and aft lower segments define an aft section, the aft section being tapered. The contour of the forward upper segment corresponds to the cavity streamline determined at an angle of $(\alpha - x\Delta\alpha)$ where $\alpha$ is a design angle of attack of the dualcavitating hydrofoil during normal supercavitating operation, $\Delta\alpha$ is a predetermined operational variation of the design angle of attack experienced by the dualcavitating hydrofoil during normal supercavitating operation, and x is a parameter between 1.0 and 1.4. The contour of the aft upper segment is adapted to provide a complete pressure recovery such that boundary layer separation over the upper surface is avoided during normal subcavitating operation.

In one embodiment of the dualcavitating hydrofoil, the lower surface constitutes a supercavitating profile having a concave curvature in at least the aft lower segment wherein during normal supercavitating operation the lower surface functions to generate a fully developed cavity extending aft from the leading edge such that during normal supercavitating operation the upper surface is completely enveloped within the cavity. In another embodiment, the forward lower segment constitutes a supercavitating profile for providing the lift force during normal supercavitating operation. The forward lower segment has a concave curvature located at least adjacent the lower junction. During normal supercavitating operation the lower surface functions to generate an upper cavity extending aft from the leading edge such that the upper surface is completely enveloped within the upper cavity, the upper cavity having a cavity streamline defined by an outer edge of the upper cavity. Furthermore, during normal supercavitating operation the lower surface functions to generate a lower cavity extending aft from the lower junction. The lower junction comprises a step between the forward lower segment and the aft lower segment, the step extending substantially vertically between a first end corresponding to an aft end of the forward lower segment and a second end corresponding to a forward end of the aft lower segment. The contour of the aft lower segment is adapted to form the tapered aft section such that the aft lower segment is completely enveloped within the lower cavity during normal supercavitating operation and wherein during normal subcavitating operation a fluid flowing over the lower surface and experiencing local separation at the lower junction reattaches to the aft lower segment.

BRIEF DESCRIPTION OF THE DRAWINGS

The foregoing objects and other advantages of the present invention will be more fully understood by reference to the following description taken in conjunction with the accompanying drawings wherein like reference numerals refer to like or corresponding element throughout and wherein.

DETAILED DESCRIPTION OF THE PREFERRED EMBODIMENT

Figure 1:
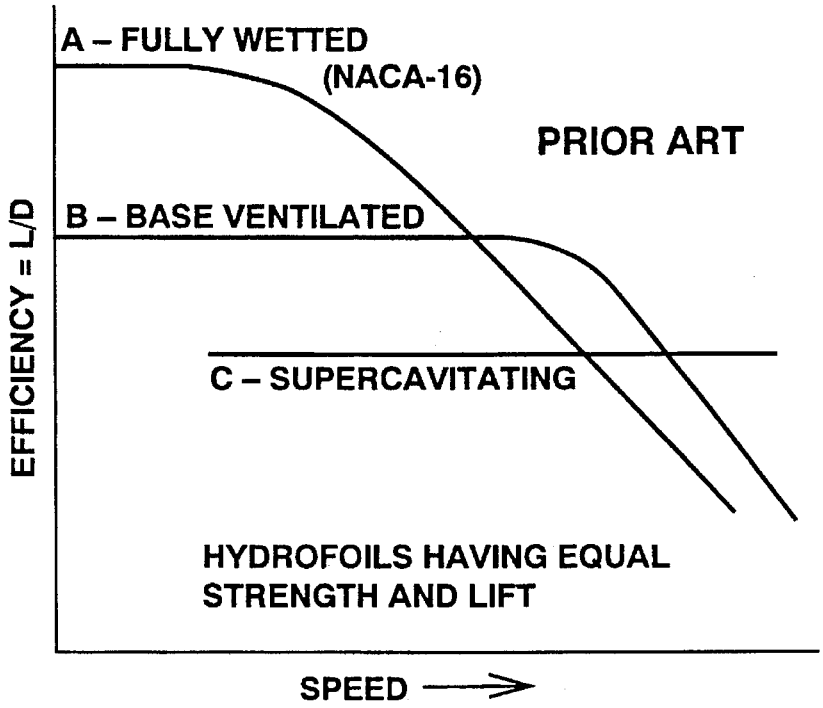
FIG. 1 is a graphic comparison of prior art hydrofoil efficiencies as represented by the lift-to-drag ratio.

Referring now to the drawings, and particularly to FIGS. 2–13, dualcavitating hydrofoil 10 of the present invention is a new class of hydrofoil structure that can be operated efficiently in a subcavitating condition at low speeds (below about 45 knots), a base cavitating condition at intermediate speeds (between about 40 and 50 knots), and a supercavitating condition at high speeds (above about 50 knots). Dualcavitating hydrofoil 10 may be constructed of any material suitable for use in a marine environment that provides adequate strength properties, such as for example, metal, metal composites, and non-metal composites such as fiber reinforced resin or plastic composites. As depicted in FIGS. 2*a* and 2*b*, dualcavitating hydrofoil 10 is installed on hydrofoil craft marine vehicle 12. Dualcavitating hydrofoil 10 may be mounted on marine vehicle 12 in any well known manner and the method of mounting dualcavitating hydrofoil 10 on marine vehicle 12 is not intended as a limitation on the present invention. The type and size of marine vehicle 12 with which dualcavitating hydrofoil 10 is used is not intended to be a limitation on the present invention.

Figure 2A:
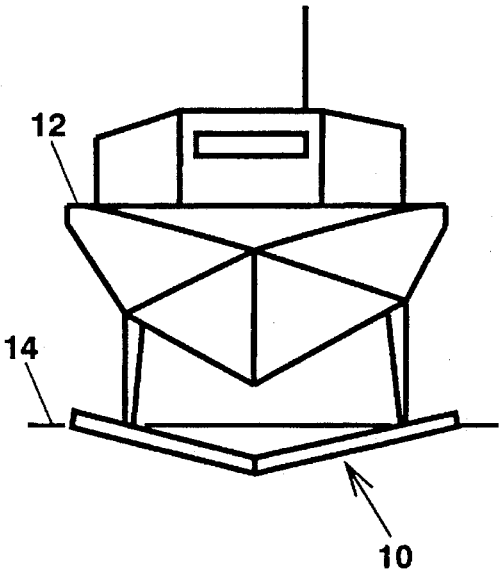
FIG. 2*a* shows a surface piercing hydrofoil arrangement.
Figure 2B:
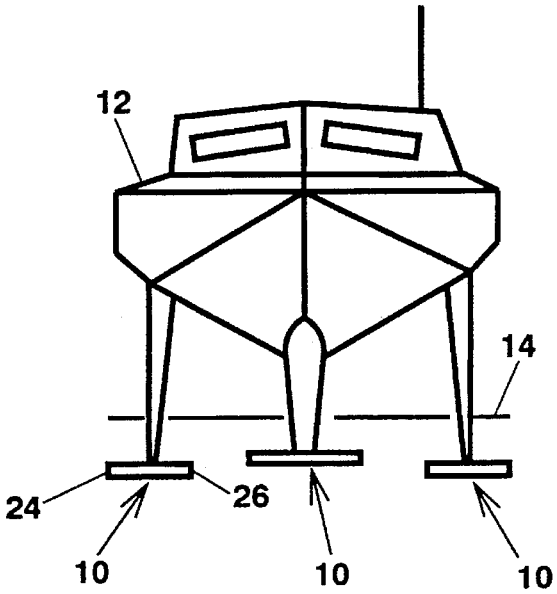
FIG. 2*b* shows a fully submerged hydrofoil arrangement.

Many different hydrofoil craft configurations are possible, although typically there must be lifting surfaces forward and aft for longitudinal stability. Two basic types of hydrofoil crafts 12 based on the hydrofoil lifting surface configuration are shown in FIGS. 2*a* and 2*b*. FIG. 2*a* shows a surface piercing hydrofoil arrangement while FIG. 2*b* shows a fully submerged hydrofoil arrangement. Surface piercing hydrofoils are characterized by inherent static and dynamic stability in pitch, roll, yaw and heave through area stabilization. A deviation from the equilibrium position causes a change in the lift-producing wetted area which creates restoring forces and moments. Stability of fully submerged hydrofoils is generally maintained through lift modulation (modification of lift force in relation to craft position) by way of either incidence control (controlling the hydrofoil angle of attack or the craft trim), actuating trailing edge flaps, and/or air feed into the suction side of the foil. Methods of lift modulation, which are well known in the art, may be used with the present invention.

A hydrofoil craft has two modes of operation: the slow-speed hullborne mode and, with increasing speed through the take-off, the flying or foilborne mode. At hullborne mode the craft behaves like a planing hull with its characteristic hump resistance. Take-off may occur at speeds near the maximum hullborne drag (hump speed) with subsequent acceleration to design speed (cruise speed), which may be two or more times the take-off speed. The drag-speed characteristics of hydrofoil crafts have a broad minimum between hump speed and cruising speed beyond which resistance begins to climb rapidly. In the foilborne mode, the effective lift-to-drag ration (L/D) must be adequate for the intended operation of the hydrofoil craft. That is, dualcavitating hydrofoil 10 must generate sufficient dynamic lift to achieve take-off and to maintain foilborne operation at its design speed (cruise speed) in its particular operating environment. Operating environment generally refers to a) anticipated seaway seen by dualcavitating hydrofoil 10 (sea-states environment at its projected operational locale), and b) whether dualcavitating hydrofoil 10 is operating in a subcavitating, base cavitating or supercavitating mode.

Flow over a hydrofoil lifting surface operating in a fluid medium generates a pressure differential between the upper and lower surfaces of the foil resulting in a lift force. The lift force produced varies with the foil's angle of attack (angle of foil chord relative to the incoming undisturbed free stream flow) and the incoming flow velocity (velocity of foil relative to the undisturbed free stream flow into the foil). In order to achieve take-off and foilborne operation, the lift produced by dualcavitating hydrofoil 10 must equal the weight of marine vehicle 12, i.e., $$W=L=(\partial C_L/\partial\alpha)\alpha(\rho V^2/2)A \quad (1)$$

where W, L, $(\partial C_L/\partial\alpha)$, $\alpha$, $\rho$, V and A are the vehicle weight, hydrofoil lift, lift-curve slope, hydrofoil angle of attack, water density, vehicle speed, and hydrofoil wetted area, respectively. The theoretical lift-curve slope is equal to $2\pi$ for the subcavitating flow condition, is equal to $\pi/2$ for the supercavitating flow condition, and is between those two values for base cavitating/base ventilated operation.

Generally, once the size, weight, and intended operational envelope of marine vehicle 12 are known, the designer can determine the span, operating depth and configuration of dualcavitating hydrofoil 10. Based on equation (1), dualcavitating hydrofoil 10 generates the required lift to achieve take-off and to maintains low drag (high L/D) foilborne operation at subcavitating, base cavitating, and supercavitating speeds by using the difference in lift-curve slope among subcavitating, base cavitating, and supercavitating operation, and by varying the hydrofoil wetted area and angle of attack. The wetted area of dualcavitating hydrofoil 10 is different during subcavitating, base cavitating, and supercavitating operation. The hydrofoil angle of attack may be varied by physically adjusting the hydrofoil angle relative to the incoming flow using well-known incidence control devices or by adjusting the running trim of the vehicle. Mechanical methods of controlling foil angle and vehicle trim are well-known in the art and thus will not be described in detail herein. Such methods are not intended to be a limitation on the present invention.

Dualcavitating hydrofoil 10 provides the dynamic lift force to lift marine vehicle 12 above water surface 14. As shown in FIGS. 2–8 and 10–12, dualcavitating hydrofoil 10 includes upper surface 20 and lower surface 22. Upper and lower surfaces, 20 and 22, are designed as a unit using Eppler's section profile design theory (described more fully below). Upper and lower surfaces, 20 and 22, extend between first and second lateral ends, 24 and 26. Dualcavitating hydrofoil 10 further includes leading edge 28 formed by the forward or upstream intersection of upper surface 20 and lower surface 22, and trailing edge 30 formed by the rearward or downstream intersection of upper surface 20 and lower surface 22. The span of dualcavitating hydrofoil 10 is defined as the straight line distance between first and second lateral ends, 24 and 26. The straight line distance between leading edge 28 and trailing edge 30 defines the chord. Herein, the plane of dualcavitating hydrofoil 10 is defined as the plane passing through leading edge 28 and trailing edge 30.

The orientation of dualcavitating hydrofoil 10 with respect to the undisturbed free stream is known as the angle of attack $\alpha$. Thus, the angle of attack of dualcavitating hydrofoil 10 is the angle between the plane of dualcavitating hydrofoil 10 and the free stream velocity vector (direction of the free stream into dualcavitating hydrofoil 10). The design angle of attack during subcavitating and supercavitating operation are not necessarily the same. Therefore, the angle of attack of dualcavitating hydrofoil 10 may be varied during the different operational modes using well known incidence control devices to vary the actual orientation of dualcavitating hydrofoil 10 or by modifying the trim of marine vehicle 12.

Herein, in the specification and claims, the terms "normal subcavitating operation" and "normal supercavitating operation" are used and will now be defined. Dualcavitating hydrofoil 10 is designed to produce lift sufficient to achieve take-off and to maintain foilborne operation at a particular design speed and design angle of attack. Moreover, dualcavitating hydrofoil 10 will generate this lift efficiently over a known range of operation in terms of angle of attack and speed. Hydrofoil craft are typically designed to operate in both calm water and a seaway. In a seaway, the lifting surfaces of a hydrofoil craft experience changes in angle of attack due to both water orbital motion and craft motion. During normal operations, dualcavitating hydrofoil 10 experiences small to moderate angle of attack variations. The variation in angle of attack can be determined by an experienced hydrofoil designer based on his or her experience and knowledge of the craft's operational speed range and sea states experience at the craft's intended operational location.

"Normal subcavitating operation" refers to operation at subcavitating speeds (generally between take-off speed and about 45 knots) at operational angles of attack equal to $(\alpha_{SUB} \pm\Delta\alpha_{SUB})$ where $\alpha_{SUB}$ is the subcavitating design angle of attack of dualcavitating hydrofoil 10 and $\Delta\alpha_{SUB}$ is a predetermined operational variation of the design angle of attack experienced over the subcavitating speed range of interest. During "normal subcavitating operation" both upper surface 20 and lower surface 22 are fully wetted (in certain preferred embodiments described below, lower surface 22 may experience small areas of locally separated flow) and upper surface 20 produces substantially all of the dynamic lift by generating a low pressure region over upper surface 20.

"Normal supercavitating operation" refers to operation at supercavitating speeds (generally above about 50 knots) at operational angles of attack equal to $(\alpha_{SUPER}\pm\Delta\alpha_{SUPER})$ where $\alpha_{SUPER}$ is the supercavitating design angle of attack of dualcavitating hydrofoil 10 and $\Delta\alpha_{SUPER}$ is a predetermined operational variation of the design angle of attack experienced over the supercavitating speed range of interest. During "normal supercavitating operation" upper surface 20 is completely enveloped within cavity 46 while lower surface 22 is fully or partially wetted and lower surface 22 produces substantially all of the dynamic lift by generating a high pressure region over lower surface 22.

Upper and lower surfaces, 20 and 22, function to provide the predetermined lift force required for foilborne operation during normal subcavitating operation at subcavitating speeds of below about 45 knots and during normal supercavitating operation at supercavitating speeds of above about 50 knots. To generate adequate suction pressure on upper surface 20 during normal subcavitating operation and to minimize form drag during normal supercavitating operation, thus increasing efficiency, upper and lower surfaces, 20 and 22, are cooperatively designed to define a plurality of streamlined cross-sectional profiles 32. Streamlined cross-sectional profiles 32 are spaced in the spanwise direction between first and second lateral ends, 24 and 26. Each profile 32 extends in the chordwise direction between leading edge 28 and trailing edge 30. Thus, profiles 32 are cross-sectional cuts perpendicular to the foil span and residing in parallel planes that are perpendicular to the foil span and to the plane of dualcavitating hydrofoil 10.

Dualcavitating hydrofoil 10 overcomes cavitation problems associated with high speed operation of prior art subcavitating hydrofoil structures by providing lower surface 22 having a supercavitating profile shape to achieve a supercavitating condition at high speeds. Generally, the shape of lower surface 22 is tailored to the specific operating range of marine vehicle 12. That is, if marine vehicle 12 will be spending most of its time at subcavitating speeds, the supercavitating profile shape of lower surface 22 will have less camber than if marine vehicle 12 were to spend most of its time at supercavitating speeds. Thus, generally, supercavitating profile camber will increase with increasing time spent in supercavitating operation.

Dualcavitating hydrofoil 10 overcomes problems associated with low speed operation of prior art supercavitating hydrofoil structures by providing upper surface 20 that combines with lower surface 22 to form streamlined cross-sectional shape 32. Streamlined cross-sectional shape 32 satisfies the Kutta condition and achieves a smooth flow exit at trailing edge 30, thus, realizing efficient (low drag, high lift) subcavitating operation. Additionally, wetted area is increased during subcavitating operation. As a result, when used as a lifting surface on a hydrofoil craft, dualcavitating hydrofoil 10 provides a structure capable of efficiently achieving take-off and foilborne operation in a subcavitating mode and switching to a base cavitating or supercavitating mode for efficient high speed operation.

Upper surface 20 is divided generally into two adjacent segments: forward upper segment 34 formed by the portion of upper surface 20 extending aft from leading edge 28; and aft upper segment 36 formed by the portion of upper surface 20 extending forward from trailing edge 30. The aft end of forward upper segment 34 is adjacent the forward end of aft upper segment 36 at upper junction 37. Lower surface 22 is divided generally into two adjacent segments: forward lower segment 38 formed by the portion of lower surface 22 extending aft from leading edge 28; and aft lower segment 40, formed by the portion of lower surface 22 extending forward from trailing edge 30. The aft end of forward lower segment 38 is adjacent the forward end of aft lower segment 40 at lower junction 41. Forward upper and forward lower segments, 34 and 38, define forward section 42 while aft upper and aft lower segments, 36 and 40, define tapered aft section 44. Tapered aft section 44 provides a smooth flow exit at trailing edge 30. In a preferred embodiment of dualcavitating hydrofoil 10, forward section 42 adjacent leading edge 28 defines a sharp leading edge.

Upper surface 20 is shaped and constructed to efficiently produce substantially all of the predetermined required lift force during normal subcavitating operation by generating a low pressure region over upper surface 20. During normal subcavitating operation, both upper and lower surfaces, 20 and 22, are fully wetted. Lower surface 22 is shaped and constructed to efficiently produce substantially all of the predetermined required lift force during normal supercavitating operation by generating a high pressure region over lower surface 22. During normal supercavitating operation, lower surface 22 functions to generate air or vapor filled cavity 46 extending aft from leading edge 28 such that upper surface 20 is completely enveloped within cavity 46 and lower surface 22 is at least partially wetted. The shape of cavity 46 is defined by cavity streamline 48 which corresponds to the outer edge of cavity 46, i.e., the interface between cavity 46 and the surrounding water. Using well known supercavitating theory, the shape and extent of cavity 46 as defined by cavity streamline 48 can be determined for any particular supercavitating profile shape (i.e., any particular shape of lower surface 22), speed, and angle of attack.

Figure 3:
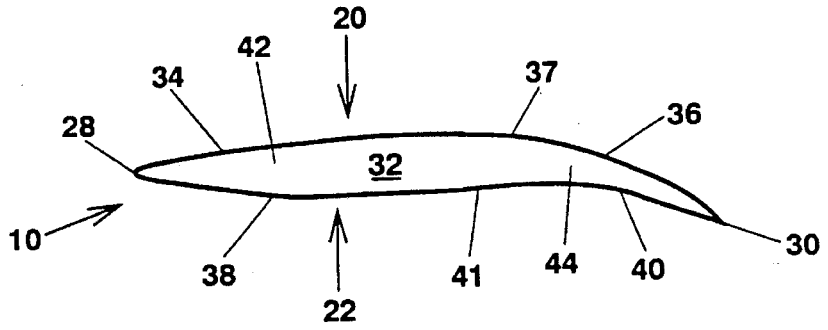
FIG. 3 shows an exemplary embodiment of the present invention under normal subcavitating operation.
Figure 4:
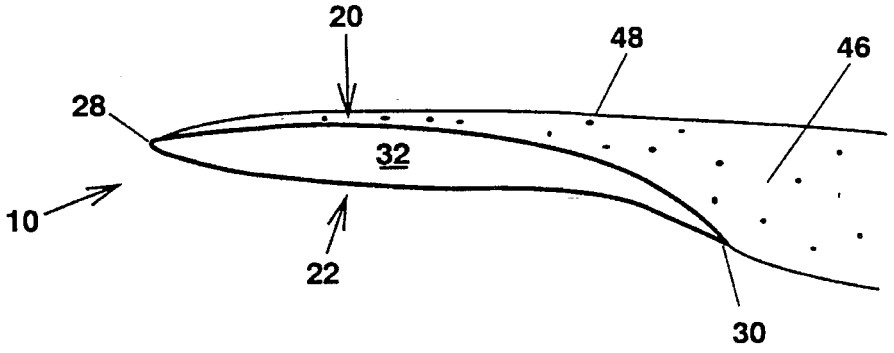
FIG. 4 shows the embodiment of FIG. 3 under normal supercavitating operation.
Figure 5:
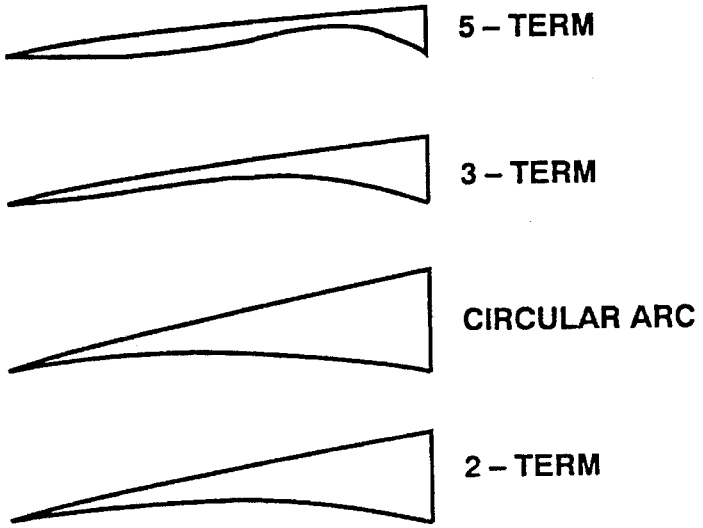
FIG. 5 shows exemplary supercavitating profiles.

In an exemplary embodiment of dualcavitating hydrofoil 10, as depicted in FIGS. 3 and 4, lower surface 22 constitutes a supercavitating profile wherein during normal supercavitating operation, as shown in FIG. 4, lower surface 22 functions to generate cavity 46 extending aft from leading edge 28 such that upper surface 20 is completely enveloped within cavity 46. The supercavitating profile of lower surface 22 comprises a concave or convex-concave contour that results in increased pressure over the lower surface and produces cavity 46 at supercavitating speeds. The supercavitating profile of lower surface 22 may be, for example, a circular arc, a 2-term supercavitating section, a 3-term supercavitating section, or a 5-term supercavitating section as shown in FIG. 5.

The contour of forward upper segment 34 corresponds to cavity streamline 48 determined at the predetermined design speed and at an angle of ($\alpha_{SUPER}$−x$\Delta\alpha_{SUPER}$) where $\alpha_{SUPER}$ is the supercavitating design angle of attack of dualcavitating hydrofoil 10, $\Delta\alpha_{SUPER}$ is the predetermined operational variation of the design angle of attack experienced by dualcavitating hydrofoil 10 during normal supercavitating operation, and x is an operational parameter that may be varied by the designer based on his or her experience and knowledge of the intended operational environment. Preferable x is between 1.0 and 1.4.

Starting from the stagnation point, during normal subcavitating operation, flow over dualcavitating hydrofoil 10 is accelerated in the chordwise direction. The local velocity is V and the free stream velocity relative to dualcavitating hydrofoil 10 is $V_\infty$. At certain locations along upper surface 20, this leads to $V/V_\infty > 1$, with local pressure falling below that of the surrounding fluid. To prevent flow separation over upper surface 20, the dynamic pressure in the vicinity of the trailing edge must be lowered to values corresponding to $V/V_\infty < 1$. This region of flow is called the pressure recovery region.

Figure 9:
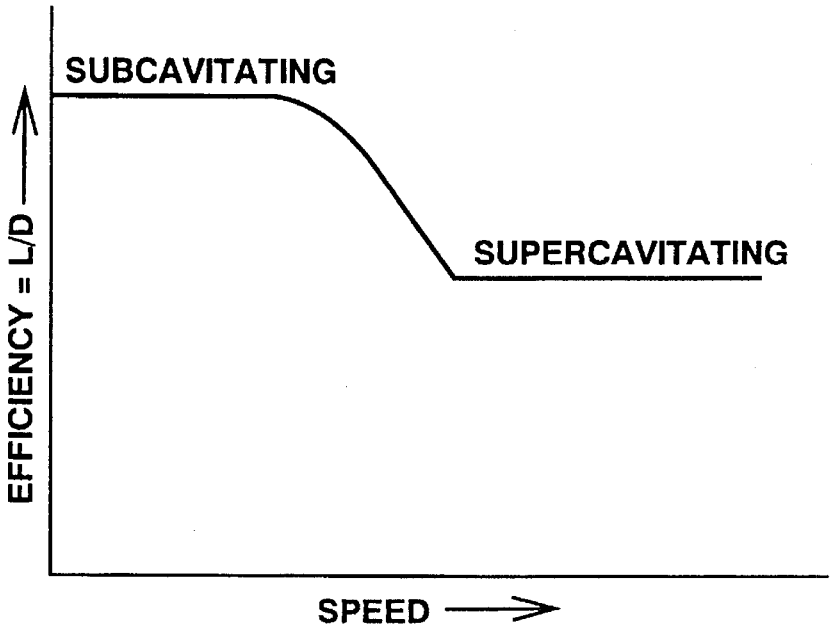
FIG. 9 is a graphic representation of efficiency (as represented by the lift-to-drag ratio L/D) of the embodiments of FIGS. 3–4 and 6–8.

Using the section profile design theory more fully described below, the contour of aft upper segment 36 is adapted to provide a complete pressure recovery such that boundary layer separation over upper surface 20 is avoided during normal subcavitating operation. In a preferred embodiment of the present invention, upper junction 37 is located such that the length of aft upper segment 36 is the minimum length required for complete pressure recovery. This embodiment of dual cavitating hydrofoil 10 is specially suitable for a design speed of between about 50 and 60 knots. At speeds less than about 45 knots the present embodiment operates in the subcavitating mode as shown in FIG. 3. As speed increases, and cavitation number decreases, cavity 46 initiates from leading edge 28 and the hydrofoil operates in the supercavitating mode as shown in FIG. 4. FIG. 9 is a graphical representation of efficiency (as represented by the lift-to-drag ratio L/D) of the present embodiment.

Figure 6:
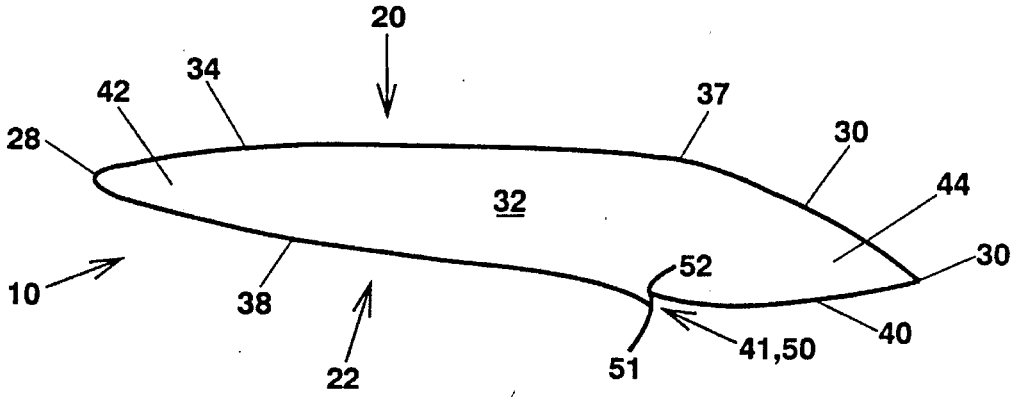
FIG. 6 shows a further exemplary embodiment of the present invention under normal subcavitating operation.
Figure 7:
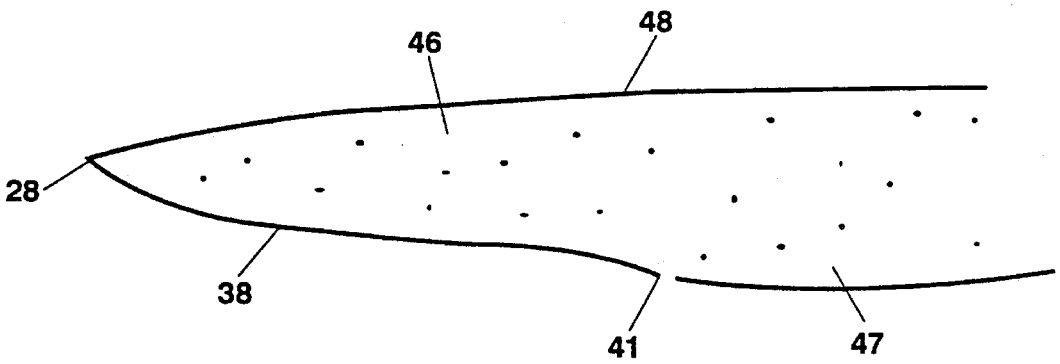
FIG. 7 represents the embodiment of FIG. 6 under normal supercavitating operation showing the supercavitating lower surface and the upper and lower cavity streamlines.

In a further exemplary embodiment, as depicted in FIGS. 6 and 7, forward lower segment 38 constitutes a supercavitating profile for providing the required lift force during normal supercavitating operation at supercavitating speeds. Thus, forward lower segment 38 must provide sufficient wetted area to generate the required lift during normal supercavitating operation. Forward lower segment 38 has a concave curvature located at least adjacent to lower junction 41, wherein during normal supercavitating operation lower surface 38 functions to generate an upper cavity 46 extending aft from leading edge 28 such that upper surface 20 is completely enveloped within said upper cavity 46. The supercavitating profile of forward lower segment 38 may be, for example, a circular arc, a 2-term supercavitating section, a 3-term supercavitating section, or a 5-term supercavitating section as shown in FIG. 5. The shape of upper cavity 46 is defined by cavity streamline 48 which corresponds to the outer edge of upper cavity 46. Furthermore, during normal supercavitating operation lower surface 22 functions to generate lower cavity 47 extending aft from lower junction 41.

Figure 8:
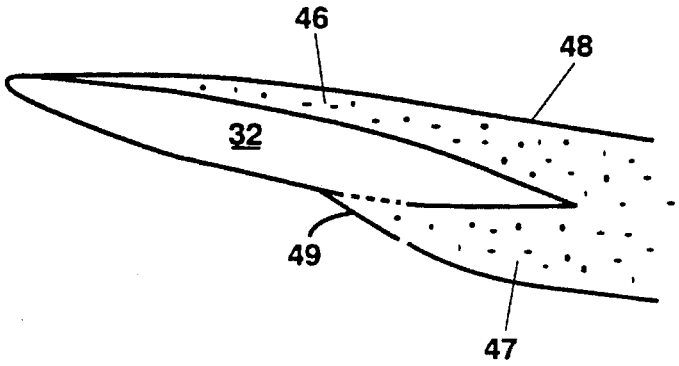
FIG. 8 shows the embodiment of FIG. 6 with the step being provided by an extended flap.

Lower junction 41 comprises step 50 between forward lower segment 38 and aft lower segment 40. Step 50 extends between first end 51 corresponding to the aft end of forward lower segment 38 and second end 52 corresponding to the forward end of aft lower segment 40. Step 50 is preferably a substantially vertically extending step, although it may vary as much as about 30° to either side of vertical as long as it does not interfere with cavity formation or with any locally separated subcavitating flow reattaching to aft lower segment 40. Alternatively, as shown in FIG. 8, flap 49 may be provided at lower junction 41. Flap 49 is extended for supercavitating operation to provide step 50. Thus, forward lower segment 38 and flap 49 simulate a supercavitating profile.

Using supercavitating theory to determine the shape of lower cavity 47 and the section profile design theory to match the surface contour of aft lower segment 40 with the predetermined pressure profile required to generate the necessary lift force during normal subcavitating operation, the contour of aft lower segment 40 is determined. Thus, the contour of aft lower segment 40 is adapted to form tapered aft section 44 wherein aft lower segment 40 is completely enveloped within lower cavity 47 during normal supercavitating operation and wherein any flow separating locally from lower junction 41 during normal subcavitating operation reattaches to aft lower segment 40. As shown in equation (1), the additional wetted area provided by aft lower segment 40 during normal subcavitating operation provides the increased lift necessary for take-off. This embodiment of dual cavitating hydrofoil 10 is specially suitable where the ratio of design speed to take-off speed is higher than for the previous embodiment, i.e., for design speeds above about 60 knots. As the ratio of design speed to take-off speed increases, the additional wetted area provided by aft lower segment 40 to achieve take-off must also increase. Thus, as the ratio of design speed to take-off speed increases, the chordwise length of aft lower segment 40 from lower junction 41 to trailing edge 30 increases.

The contour of forward upper segment 34 corresponds to cavity streamline 48 determined at the predetermined design speed and at an angle of ($\alpha_{SUPER}$−x$\Delta\alpha_{SUPER}$). Using the section profile design theory, the contour of aft upper segment 36 is adapted to provide a complete pressure recovery such that boundary layer separation over upper surface 20 is avoided during normal subcavitating operation. In a preferred embodiment of the present invention, upper junction 37 is located such that the length of aft upper segment 36 is the minimum length required for complete pressure recovery. At speeds less than about 45 knots the present embodiment operates in the subcavitating mode as shown in FIG. 6. As speed increases, and cavitation number decreases, cavity 46 initiates from leading edge 28, cavity 47 initiates from step 50, and the hydrofoil operates in the supercavitating mode as shown in FIG. 7. FIG. 9 is a graphical representation of efficiency (as represented by the lift-to-drag ratio L/D) of the present embodiment.

The maximum vertical height of step 50 substantially corresponds to the boundary layer thickness of a fully attached fluid flowing over lower surface 22, wherein the boundary layer thickness is determined at lower junction 41 at a predetermined operating condition. The predetermined operating condition at which the boundary layer thickness is determined is preferably the take off speed for the vehicle. Alternatively, the predetermined operating condition can correspond to the hump speed of the vehicle or to the maximum subcavitating speed.

The boundary layer is the region of fluid close to the body where, owing to viscosity, the normal gradients of velocity are large as compared with longitudinal variations, and thus, the shear stress is significant. In the boundary layer the velocity of the fluid u increases from zero at the surface of the body to its maximum value U, which corresponds to the velocity of the inviscid stream, i.e., the local external velocity relative to the body. The boundary layer thickness $\delta$ is the distance above and normal to the surface of the body to the point at which the speed attains its equivalent external flow velocity relative to the body. That speed is conventionally determined by the equation u= 0.99 U which means that the boundary layer thickness is determined at the point where the local flow speed u is 99 percent of the local external velocity U of the inviscid fluid relative to the body. The boundary layer thickness varies along the body, being zero at the leading edge and increasing downstream of the leading edge. Empirical expressions for the boundary layer thickness are well known in the art, e.g., Blasius' formulation for laminar flow $\delta(x)= 5.2x/(R_x)^{1/2}$ and Von Karmans' formulation for turbulent flow $\delta(x)= 0.37x/(R_x)^{1/5}$, where x is the distance measured downstream from the leading edge, and $R_x$ is the Reynolds number at x ($R_x$= Ux/$\nu$, where $\nu$ is the coefficient of kinematic viscosity of the fluid). Other methods of determining the boundary layer thickness have been developed using viscous flow theory and are well known in the art. For example, boundary layer thickness calculations may be performed using computational fluid dynamics (CFD) techniques based on solution of the Navier-Stokes equations. Since the determination of boundary layer thickness over a streamlined body is well known in the art it will not be disclosed in detail herein.

Generally, in the previous described embodiments, upper and lower surfaces, 20 and 22, are design as an integral unit using well known supercavitating theory originated by Tulin and Burkart and section profile design theory originated by Eppler. Initially the required lift force is determined. Using well known supercavitating theory, the supercavitating profile of lower surface 22 or forward lower segment 38 is determined to provide the required lift at the supercavitating design speed and design angle of attack. When operating in a normal supercavitating mode, supercavitating lower surface 22 will produce a cavity 46 at any particular speed and angle of attack irrespective of upper surface 20. Therefore, once the supercavitating profile of lower surface 22 is specified, the shape of cavity 46 at the design speed and design cavitation number is specified, thus defining the shape of and pressure distribution over forward upper segment 34. The shape of aft upper segment is then determined using the section profile design theory by requiring complete pressure recovery over upper surface 20.

Figure 10:
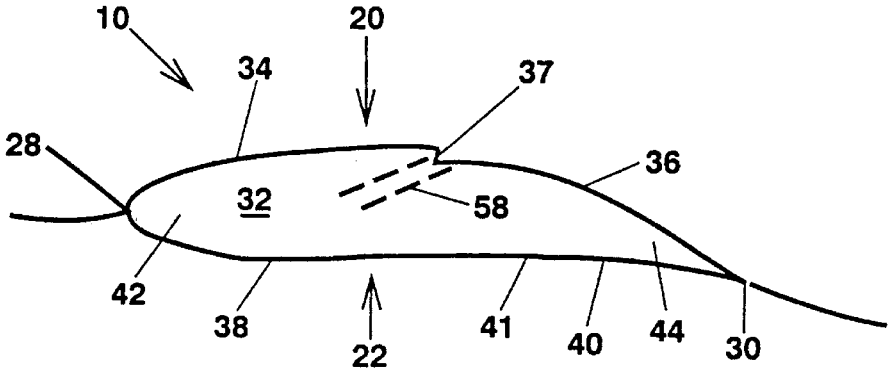
FIG. 10 shows still a further exemplary embodiment of the present invention under normal subcavitating operation.
Figure 11:
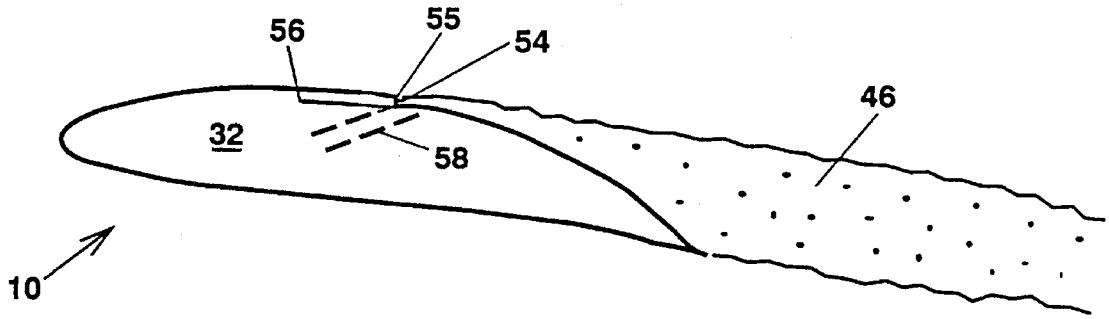
FIG. 11 shows the embodiment of FIG. 10 under base cavitating or base ventilated operation.
Figure 12:
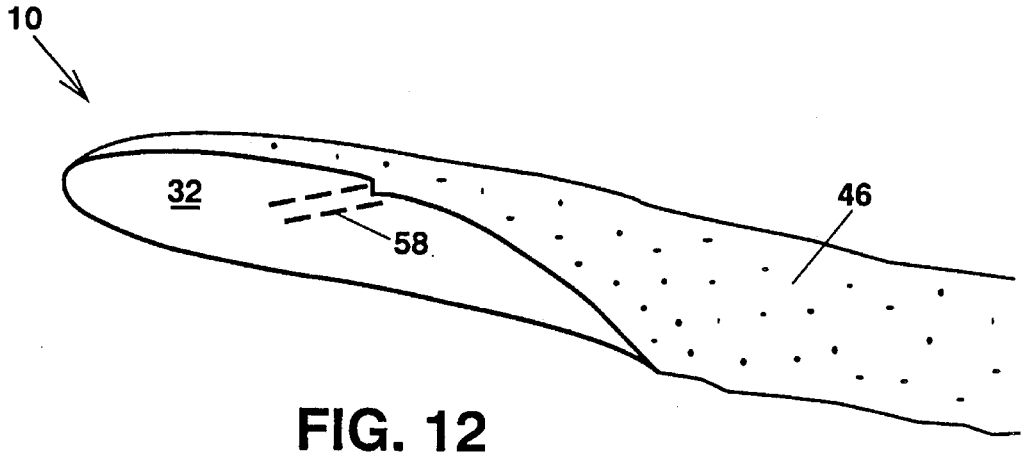
FIG. 12 shows the embodiment of FIG. 10 under supercavitating or superventilated operation.

In still a further exemplary embodiment of dualcavitating hydrofoil 10, as depicted in FIGS. 10 through 12, streamlined cross-sectional shape 32 is an airfoil shape having a rounded leading edge 28, a convex upper surface 20 and a concave lower surface 22 to simulate a supercavitating profile. Cross-sectional profile 32 may be iteratively determined using the section profile design theory by requiring lower surface 22 to be concave and to generate the required lift during normal supercavitating operation. Lower surface 22 should be concave in at least aft lower segment 40 wherein lower junction 41 is located about two-thirds of the chordlength aft of leading edge 28 such that aft lower segment 40 comprises about the aft third of lower surface 22. Upper junction 37 comprises step 54 between forward upper segment 34 and aft upper segment 36. Step 54 extends substantially vertically between first end 55 corresponding to the aft end of forward upper segment 34 and second end 56 corresponding to the forward end of aft upper segment 36. Upper junction 37 is located adjacent to the point of maximum calculated $-C_{Pmin}$, and preferably immediately aft of the point of maximum calculated $-C_{Pmin}$. Preferably, the maximum vertical height of step 54 substantially corresponds to a fully attached boundary layer thickness of a fluid flowing over upper surface 20, the boundary layer thickness being determined at upper junction 37 at a predetermined operating speed such that during normal subcavitating operation any fluid flowing over upper surface 20 that experiences local separation at upper junction 37 (i.e., step 54) reattaches to aft upper segment 36. The predetermined operating condition at which the boundary layer thickness is determined is preferably the take off speed for the vehicle. Alternatively, the predetermined operating condition can correspond to the hump speed of the vehicle or to the maximum subcavitating speed. Additionally, an air venting system for emitting air from upper surface 20 through vent 58 located at upper junction 37 may be incorporated to initiate a base ventilated conditions or a superventilated condition. Systems for venting gas from a surface into a flow, comprising among other things an air or gas source, pipes or tubes for transporting the gas from the source to the vent, one or more vents in the surface, and a control system for regulating the gas flow, are well known in the art and will not be described in detail here.

Figure 13:
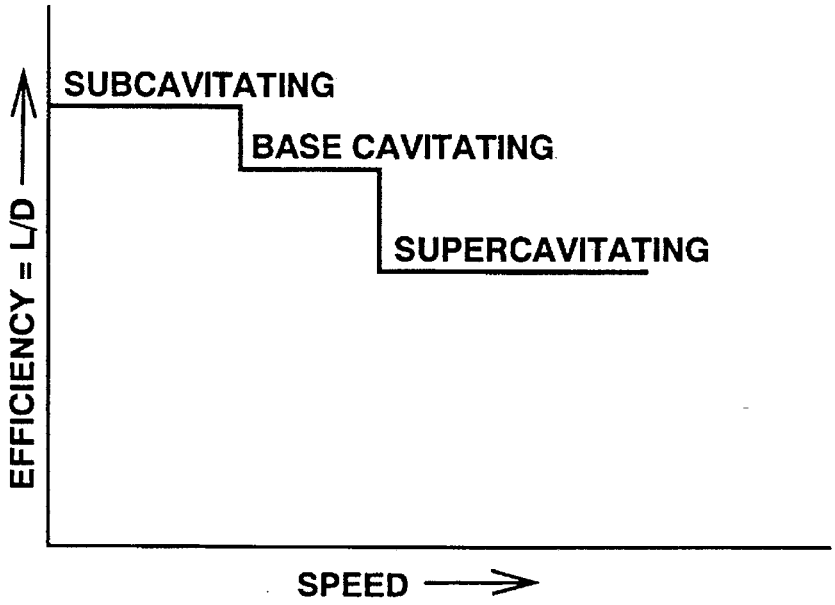
FIG. 13 is a graphic representation of efficiency (as represented by the lift-to-drag ratio L/D) of the embodiment of FIGS. 10 through 12.

At speeds below about 45 knots, this embodiment of dualcavitating hydrofoil 10 operates in a normal subcavitating mode as shown in FIG. 10. At speeds between about 40 knots and 50 knots, dualcavitating hydrofoil 10 may be operated in the base cavitating or base ventilated mode as shown in FIG. 11. Above about 50 knots, the present embodiment operates in the supercavitating or superventilated mode as shown in FIG. 12. FIG. 13 is a graphical representation of efficiency (as represented by the lift-to-drag ratio L/D) of the present embodiment.

As stated above, to produce an efficient hydrofoil over a speed range encompassing both subcavitating and supercavitating speeds, the upper and lower surfaces are designed together as a single unit using Tulin's supercavitating theory and Eppler's section profile design theory. The section profile design theory developed by Eppler in the early 1970's is an important, well known and extensively used method for performing wing, propeller and hydrofoil section design. The profile design theory was developed to determine the coordinates of an airfoil section profile from a prescribed pressure or velocity distribution. The upper and lower surfaces are designed together as a unit to produce a profiles that maximizes efficiency while producing the prescribed pressure or velocity distribution. The profile is obtained through a procedure of conformal mapping. The profile design theory, as described in Eppler, R., "Direkte Berechnung von Tragflugelprofilenen aus der Drukverteilung," Ingenier-Archive, Vol. 25, 1957, pp. 32–59; NASA Technical Translation, NASA TT F-15, 417, March 1974, is well known in the art and will not be described in detail herein. Application of the profile design theory to symmetrical and nonsymmetrical profiles for subcavitating hydrofoils are presented in: Eppler, Richard and Young T. Shen, "Wing Sections for Hydrofoils—Part 1: Symmetrical Profiles," Journal of Ship Research, Vol. 23, No. 3 (September 1979), pp. 209–217; Shen, Young T. and Richard Eppler, "Wing Sections for Hydrofoils—Part 2: Nonsymmetrical Profiles," Journal of Ship Research, Vol. 25, No. 3 (September 1981), pp. 191–200; and Shen, Young T., "Wing Sections for Hydrofoils—Part 3: Experimental Verification," Journal of Ship Research, Vol. 29, No. 1 (March 1985), pp. 39–50; herein incorporated by reference.

The pressure distribution and flow characteristics of dualcavitating hydrofoil 10 can be determined using any of a number of well known computer programs for computing airfoil or hydrofoil performance and predicting free-field velocity/pressure distributions. Examples of such numerical programs include VSAERO and MIT PSF 10. These programs, which employ panel methods to model the foil and incompressible potential flow theory to compute velocity distributions, are well known in the art and will not be described in detail here. VSAERO is available from Analytical Methods, Inc. of Redmond, Washington 98052, and is described in an AMI Report entitled "PROGRAM 'VSAERO' A Computer Program for Calculating the Nonlinear Aerodynamic Characteristics of Arbitrary Configurations," prepared by B. Maskew under Contract NAS2 -11945 for NASA Ames Research Center (December 1984). MIT PSF 10, available from the Massachusetts Institute of Technology, is described in Massachusetts Institute of Technology Doctoral dissertation entitled, "Development and Analysis of Panel Methods for Propeller Unsteady Flow," by Ching-Yeh Hsin (1990).

The advantages of the present invention are numerous. The dualcavitating hydrofoil operates efficiently over a wider speed range and produces a higher average efficiency (lift-to-drag ratio) over that speed range than prior art hydrofoils. The dual cavitating hydrofoil has high efficiency (lift-to-drag ratio) at subcavitating speeds when compared to prior art base vented or supercavitating designs. The dualcavitating hydrofoil provides operation free from the detrimental effects of cavitation over a wide speed range. The dual cavitating hydrofoil overcomes problems associated with cavitation at high speeds by unwetting the upper surface. A hydrofoil may be tailored to a specific design speed and operating environment while producing higher efficiency at off-design speeds than either base ventilated or supercavitating hydrofoils. The dualcavitating hydrofoil produces higher low speed efficiency and is less sensitive to variations in angle of attack than either base ventilated or supercavitating hydrofoils. The dualcavitating hydrofoil is capable of providing efficient operation in a subcavitating mode at speeds below about 45 knots, in a base ventilated mode at speeds between about 40 and 50 knots, and in a supercavitating mode at speeds above about 50 knots in order to provide a hydrofoil for use over a wide speed range and in both low and high sea states. The dualcavitating hydrofoil is capable of efficiently achieving take-off speed, and of operating efficiently at high speeds.

The present invention and many of its attendant advantages will be understood from the foregoing description and it will be apparent to those skilled in the art to which the invention relates that various modifications may be made in the form, construction and arrangement of the elements of the invention described herein without departing from the spirit and scope of the invention or sacrificing all of its material advantages. The forms of the present invention herein described are not intended to be limiting but are merely preferred or exemplary embodiments thereof.

What is claimed is:

1. A dualcavitating hydrofoil for providing dynamic lift to a marine vehicle, comprising:

an upper surface and a lower surface, said upper and lower surfaces functioning to provide a lift force sufficient to lift the marine vehicle above a water surface;

a leading edge formed by a forward intersection of said upper and lower surfaces;

a trailing edge formed by an aft intersection of said upper and lower surfaces;

said upper and lower surfaces defining a cross-sectional shape adapted to provide a smooth flow exit at said trailing edge during normal subcavitating operation at subcavitating speeds;

said upper surface being adapted to efficiently produce said lift force during said normal subcavitating operation at subcavitating speeds wherein said upper and lower surfaces are fully wetted; and said lower surface being adapted to efficiently produce said lift force during normal supercavitating operation at supercavitating speeds wherein said upper surface is completely enveloped within a cavity generated by said lower surface and at least a portion of said lower surface is wetted.

2. A dualcavitating hydrofoil as in claim 1, wherein:

said upper surface is divided into a forward upper segment extending aft from said leading edge and an aft upper segment extending forward from said trailing edge, said forward upper segment being adjacent said aft upper segment at an upper junction;

said lower surface is divided into a forward lower segment extending aft from said leading edge and an aft lower segment extending forward from said trailing edge, said forward lower segment being adjacent said aft lower segment at a lower junction; and wherein said forward upper and forward lower segments define a forward section and said aft upper and aft lower segments define an aft section, said aft section being tapered.

3. A dualcavitating hydrofoil as in claim 2, wherein:

said lower surface constitutes a supercavitating profile wherein during normal supercavitating operation said lower surface functions to generate said cavity extending aft from said leading edge such that said upper surface is completely enveloped within said cavity, said cavity having a cavity streamline defined by an outer edge of said cavity;

a contour of said forward upper segment corresponds to said cavity streamline determined at a predetermined design speed and an angle of $(\alpha-x\Delta\alpha)$ where $\alpha$ is a design angle of attack of said dualcavitating hydrofoil, $\Delta\alpha$ is a predetermined operational variation of said design angle of attack experienced by said dualcavitating hydrofoil during normal supercavitating operation, and x is a parameter between 1.0 and 1.4; and a contour of said aft upper segment is adapted to provide a complete pressure recovery such that boundary layer separation over said upper surface is avoided during normal subcavitating operation.

4. A dualcavitating hydrofoil as in claim 3, wherein said supercavitating profile is selected from the group consisting of a circular arc, a 2-term supercavitating section, a 3-term supercavitating section, and a 5-term supercavitating section.

5. A dualcavitating hydrofoil as in claim 3, wherein said upper junction is located such that a length of said aft upper segment is a minimum length required for said complete pressure recovery.

6. A dualcavitating hydrofoil as in claim 2, wherein:

said forward lower segment constitutes a supercavitating profile for providing said lift force during normal supercavitating operation at supercavitating speeds, said forward lower segment having a concave curvature located at least adjacent said lower junction, wherein during normal supercavitating operation said lower surface functions to generate an upper cavity extending aft from said leading edge such that said upper surface is completely enveloped within said upper cavity, said upper cavity having a cavity streamline defined by an outer edge of said upper cavity, and further wherein during normal supercavitating operation said lower surface functions to generate a lower cavity extending aft from said lower junction;

said lower junction comprises a step between said forward lower segment and said aft lower segment, said step extending between a first end corresponding to an aft end of said forward lower segment and a second end corresponding to a forward end of said aft lower segment;

a contour of said aft lower segment is adapted to form said tapered aft section such that said aft lower segment is completely enveloped within said lower cavity during normal supercavitating operation and such that a flow separating from said lower junction during normal subcavitating operation reattaches to said aft lower segment;

a contour of said forward upper segment corresponds to said cavity streamline determined at a predetermined design speed and an angle of $(\alpha-x\Delta\alpha)$ where $\alpha$ is a design angle of attack of said dualcavitating hydrofoil, $\Delta\alpha$ is a predetermined operational variation of said design angle of attack experienced by said dualcavitating hydrofoil during normal supercavitating operation, and x is a parameter between 1.0 and 1.4; and a contour of said aft upper segment is adapted to provide a complete pressure recovery such that boundary layer separation over said upper surface is avoided during normal subcavitating operation.

7. A dualcavitating hydrofoil as in claim 6, wherein said supercavitating profile is selected from the group consisting of a circular arc, a 2-term supercavitating section, a 3-term supercavitating section, and a 5-term supercavitating section.

8. A dualcavitating hydrofoil as in claim 6, wherein said upper junction is located such that a length of said aft upper segment is a minimum length required for said complete pressure recovery.

9. A dualcavitating hydrofoil as in claim 6, wherein said step is a substantially vertical step having a vertical height substantially equal to or less than a fully attached boundary layer thickness of a fluid flowing over said lower surface, the boundary layer thickness being determined at said lower junction at a predetermined operating speed.

10. A dualcavitating hydrofoil as in claim 9, wherein said predetermined operating speed is selected from the group consisting of the vehicle takeoff speed and the vehicle hump speed.

11. A dualcavitating hydrofoil as in claim 2 wherein:

said cross-sectional shape is an airfoil shape having a rounded leading edge, a convex upper surface and a concave curvature in at least said aft lower segment;

said upper junction comprises a step between said forward upper segment and said aft upper segment, said step extending substantially vertically between a first end corresponding to an aft end of said forward upper segment and a second end corresponding to a forward end of said aft upper segment, said upper junction being located adjacent to and just aft of a point of maximum calculated $-C_{Pmin}$.

12. A dualcavitating hydrofoil as in claim 11, wherein a vertical height of said step is substantially equal to or less than a fully attached boundary layer thickness of a fluid flowing over said upper surface, the boundary layer thickness being determined at said upper junction at a predetermined operating speed, wherein during normal subcavitating operation said fluid flowing over said upper surface experiences local separation at said upper junction such that said locally separated flow reattaches to said aft upper segment.

13. A dualcavitating hydrofoil as in claim 12, wherein said predetermined operating speed is selected from the group consisting of the vehicle takeoff speed and the vehicle hump speed.

14. A dualcavitating hydrofoil as in claim 13, further comprising an air venting system for emitting air from said upper surface at said upper junction.

15. A dualcavitating hydrofoil for providing a dynamic lift force sufficient to lift a marine vehicle above a water surface, comprising:

an upper surface and a lower surface, said upper and lower surfaces extending between first and second lateral ends, said upper and lower surfaces functioning to provide said lift force during normal subcavitating operation at subcavitating speeds of below about 45 knots and during normal supercavitating operation at supercavitating speeds of above about 50 knots;

a leading edge formed by a forward intersection of said upper and lower surfaces;

a forward upper segment formed by a portion of said upper surface extending aft from said leading edge;

a forward lower segment formed by a portion of said lower surface extending aft from said leading edge;

a trailing edge formed by a rearward intersection of said upper and lower surfaces;

an aft upper segment formed by a portion of said upper surface extending forward from said trailing edge; and an aft lower segment formed by a portion of said lower surface extending forward from said trailing edge, said aft upper and aft lower segments forming a tapered aft section for providing a smooth flow exit that satisfies the Kutta condition at said trailing edge;

said lower surface being shaped to efficiently produce said lift force during said normal supercavitating operation wherein said lower surface functions to generate a cavity extending aft from said leading edge, said cavity having a cavity streamline defined by an outer edge of said cavity, said upper surface being completely enveloped within said cavity and said lower surface being at least partially wetted during said normal supercavitating operation; and said upper surface being shaped to efficiently produce said lift force during said normal subcavitating operation wherein said upper and lower surfaces are fully wetted during said normal subcavitating operation.

16. A dualcavitating hydrofoil as in claim 15, wherein a contour of said forward upper segment corresponds to said cavity streamline determined at a predetermined design speed and an angle of $(\alpha-\Delta\alpha)$ where $\alpha$ is a design angle of attack of said dualcavitating hydrofoil and $\Delta\alpha$ is a predetermined operational variation of said design angle of attack experienced by said dualcavitating hydrofoil during normal supercavitating operation; and a contour of said aft upper segment is adapted to provide a complete pressure recovery over said upper surface such that boundary layer separation over said upper surface is avoided during normal subcavitating operation, a length of said aft upper segment being a minimum length required for said complete pressure recovery.

17. A dualcavitating hydrofoil as in claim 16, wherein said lower surface is a supercavitating profile selected from the group consisting of a circular arc, a 2-term supercavitating section, a 3-term supercavitating section, and a 5-term supercavitating section.

18. A dualcavitating hydrofoil as in claim 16, wherein said forward upper segment is adjacent said aft upper segment at an upper junction and said forward lower segment is adjacent said aft lower segment at a lower junction;

said forward lower segment provides said lift force during normal supercavitating operation, said forward lower segment having a concave curvature located at least adjacent said lower junction, wherein during normal supercavitating operation said lower surface functions to generate an upper cavity extending aft from said leading edge such that said upper surface is completely enveloped within said upper cavity, said upper cavity having a cavity streamline defined by an outer edge of said upper cavity, and further wherein during normal supercavitating operation said lower surface functions to generate a lower cavity extending aft from said lower junction;

said lower junction comprises a step between said forward lower segment and said aft lower segment, said step extending substantially vertically between a first end corresponding to an aft end of said forward lower segment and a second end corresponding to a forward end of said aft lower segment;

a contour of said aft lower segment is adapted to form said tapered aft section such that said aft lower segment is completely enveloped within said lower cavity during normal supercavitating operation and such that a flow separating from said lower junction during normal subcavitating operation reattaches to said aft lower segment.

19. A dualcavitating hydrofoil as in claim 18, wherein a vertical height of said step is substantially equal to or less than a fully attached boundary layer thickness of a fluid flowing over said lower surface, the boundary layer thickness being determined at said lower junction at a predetermined operating speed, said predetermined operating speed being selected from the group consisting of the vehicle takeoff speed and the vehicle hump speed.

20. A dualcavitating hydrofoil as in claim 19, wherein said forward lower segment is a supercavitating profile selected from the group consisting of a circular arc, a 2-term supercavitating section, a 3-term supercavitating section, and a 5-term supercavitating section.

* * * * *